US005415472A

United States Patent [19]

Brise

[11] Patent Number: 5,415,472

[45] Date of Patent: May 16, 1995

[54] PORTABLE SHELF

[76] Inventor: Richard A. Brise, R.R. #1, Tyee Lake Road, Telkwa, British Columbia, Canada, V0J 2X0

[21] Appl. No.: 106,265

[22] Filed: Aug. 13, 1993

Related U.S. Application Data

[63] Continuation of Ser. No. 833,322, Feb. 10, 1992, abandoned.

[51] Int. Cl.[6] ..... A47B 43/00

[52] U.S. Cl. ..... 312/257.1; 312/209; 312/303; 211/153

[58] Field of Search ..... 24/351, 408, 126, 128, 24/257.1, 209, 303, 233, 265.1, 265.2, 265.6; 211/90, 149, 153, 187; 52/243.1

[56] References Cited

U.S. PATENT DOCUMENTS

| | | | |
|---|---|---|---|
| 543,959 | 8/1895 | Foster . | |
| 774,117 | 11/1904 | Tandy | 312/303 |
| 774,879 | 11/1904 | Hullhorst | 312/209 |
| 889,156 | 5/1908 | Ruehlmann | 312/209 |
| 1,876,494 | 9/1932 | Furo . | |
| 1,997,793 | 4/1935 | Hull et al. | 312/351 |
| 3,300,265 | 1/1967 | Wilmer et al. | 312/303 |
| 3,397,934 | 8/1968 | Dushek | 312/351 |
| 4,084,703 | 4/1978 | Hossalla et al. | 211/153 |
| 4,155,312 | 5/1979 | Thorkildson | 108/137 |
| 4,351,244 | 9/1982 | Suttles | 211/187 |
| 4,658,969 | 4/1987 | Mastrodicasa | 211/153 |
| 4,736,919 | 4/1988 | Bessinger | 211/90 |
| 4,793,664 | 12/1988 | Jackson . | |
| 5,159,793 | 11/1992 | Deugo et al. | 52/243.1 |

OTHER PUBLICATIONS

LOCKER DEK Adjustable Locker Shelf packaging, 1990.

*Primary Examiner*—Victor N. Sakran

*Attorney, Agent, or Firm*—Chernoff, Vilhauer, McClung & Stenzel

[57] ABSTRACT

An adjustable-length shelf which may be removably mounted in an enclosure, such as a locker cabinet. The shelf is adjustable between a semi-collapsed position to facilitate placement of the shelf within the enclosure and a deployed position for supporting a load at the desired vertical height. The shelf includes a first section having first gripping surface for frictionally engaging one of the enclosure sidewalls, a second section pivotably coupled to the first section, and a third section releasably coupled to the second section and having a second gripping surface for frictionally engaging the other of the enclosure sidewalls.

10 Claims, 7 Drawing Sheets

PORTABLE SHELF

This is a continuation of application Ser. No. 07/833,322 filed 10 February, 1992, now abandoned.

FIELD OF THE INVENTION

This application relates to an adjustable-length shelf which may be removably mounted in an enclosure, such as a locker. The shelf is adapted for frictionally engaging the locker sidewalls to support a load at a desired vertical height within the enclosure.

BACKGROUND OF THE INVENTION

Various adjustable-length shelves are known in the prior art. U.S. Pat. No. 1,876,494, which issued to Furo on 6 September, 1932, discloses an adjustable shelf consisting of two overlapping sections pivotally coupled together. The lateral edges of the Furo shelf sections are cut-away to provide spurs for penetrating adjacent support walls when the shelf is mounted.

U.S. Pat. No. 4,155,312, which issued to Thorkildson on 22 May, 1979, discloses a two piece shelf which is telescopically adjustable in length. The lateral ends of the Thorkildson shelf are flanged to facilitate fastening the shelf to wooden structural members, as by nails or screws.

U.S. Pat. No. 534,959, which issued to Foster on 6 August, 1895, discloses a rack for books which consists of two hingedly coupled sections. To install the Foster rack, the end portions of the two shelf sections are fitted into corresponding notches formed in the upright shelf supports. The shelf is then pressed downwardly toward a horizontal position until the two shelf sections are brought in line with one another.

All of the prior art shelves and racks referred to above exhibit shortcomings which are overcome by the applicant's invention. The primary shortcoming is the need to permanently modify or deface the shelf supporting surfaces, such as by forming notches in the support walls for receiving the shelf ends or by mounting brackets and the like on the support walls for receiving screws or other fasteners.

Further, none of the prior art shelving systems are specifically adapted for mounting in an enclosure having non-parallel sidewalls. For example, school and gym lockers are often not perfectly rectangular in cross-section and thus the end surfaces of conventional shelves will not uniformly contact the interior locker sidewalls. This limits the stability and load-supporting capacity of such shelves and effectively prevents them from being maintained in position by frictional forces alone.

Accordingly, the need has arisen for an adjustable-length portable shelf which may be removably mounted within an enclosure, such as a locker, at a desired height without defacing or modifying the locker sidewalls.

SUMMARY OF THE INVENTION

In accordance with the invention, there is provided a shelf removably mountable within an enclosure having generally opposed interior sidewalls, such as a locker cabinet. The shelf includes a first section having first gripping means for releasably engaging one of the enclosure sidewalls, a second section pivotably coupled to the first section, and a third section coupled to the second section and having second gripping means for releasably engaging the other of the enclosure sidewalls.

The shelf is manually adjustable between a semi-collapsed position wherein the first and second sections extend in intersecting planes to facilitate placement of the shelf within the enclosure and a deployed position wherein the first and second gripping means engage respective enclosure sidewalls and wherein the first, second and third sections extend in a substantially common plane for supporting a load. The third section is is pivotable relative to the second section within the common plane to accommodate enclosures having non-parallel sidewalls.

Preferably, the shelf includes coupling means for releasably coupling the second and third sections together and for adjusting the displacement between the second and third sections so as to vary the overall length of the shelf. Advantageously, the coupling means includes a prong projecting from a central portion of the third section which is insertable within a mating slot formed in a central portion of the second section. The coupling means may further include a pin insertable through apertures formed in the prong and the second section for releasably coupling the second and third shelf sections together.

Each of the first and second gripping means preferably includes a resilient gripping surface for frictionally engaging the enclosure sidewalls. The gripping surfaces are disposed on opposite ends of the shelf and include elongated surfaces for uniformly distributing the load to the enclosure sidewalls

BRIEF DESCRIPTION OF THE DRAWINGS

In drawings which illustrate an embodiment of the invention, but which should not be construed as restricting the spirit or scope of the invention in any way, FIG. 1(*a*) is an isometric view of the assembled shelf in its semi-collapsed position placed within an enclosure, such as a locker cabinet;

FIG. 1(*c*) is an isometric view of the shelf of FIG. 1(*a*) and (*b*) in its fully deployed position within the enclosure;

FIG. 2(*b*) is a side elevational view of the shelf of FIG. 1(*b*);

FIG. 2(*c*) is a side elevational view of the shelf of FIG. 1(*c*);

FIG. 8(*b*) is a top, plan view of the shelf of FIG. 1 in its fully deployed position installed within an enclosure having converging sidewalls.

DETAILED DESCRIPTION OF THE PREFERRED EMBODIMENT

This application relates to a portable shelf 10 which is removably mountable within an enclosure 12 having opposed interior sidewalls 14, such as a school or gym locker. Shelf 10 may be used to support books, binders, sporting equipment and the like.

Figure 1A:
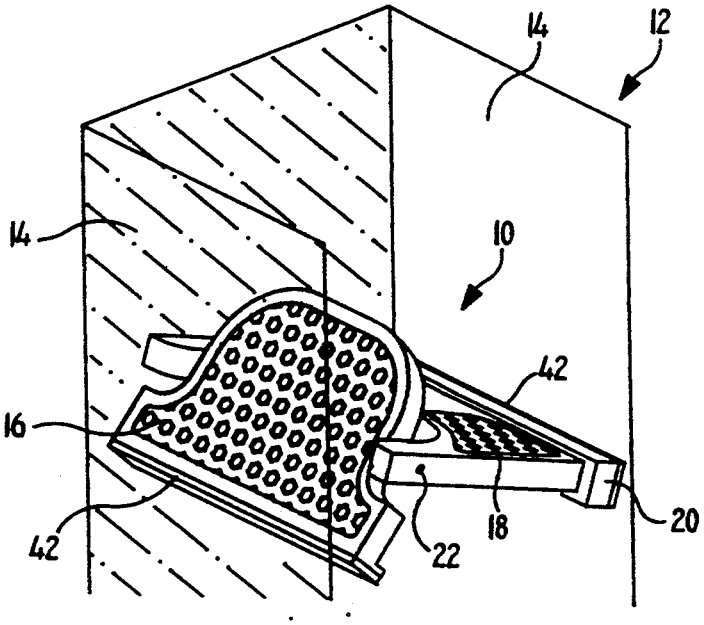
FIG. 1(*b*) is an isometric view of the shelf of FIG. 1(*a*) in its partially deployed position within the enclosure.
Figure 1B:
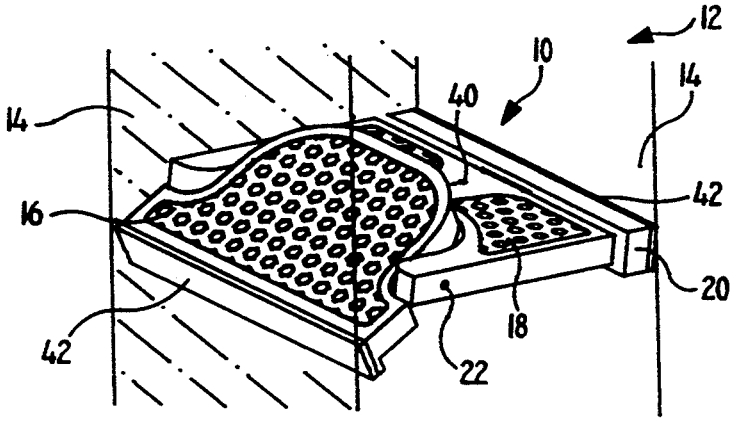
Figure 1C:
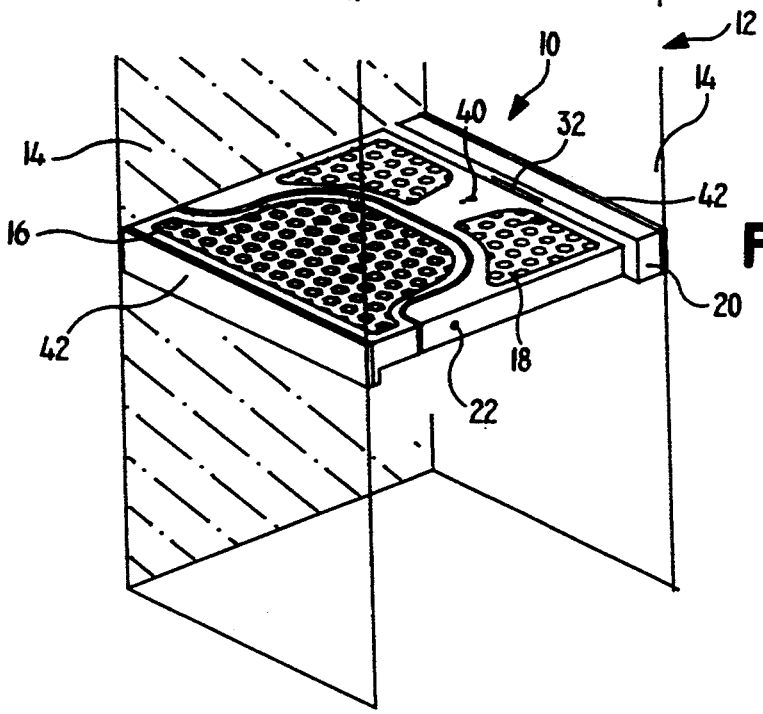
Figure 2A:
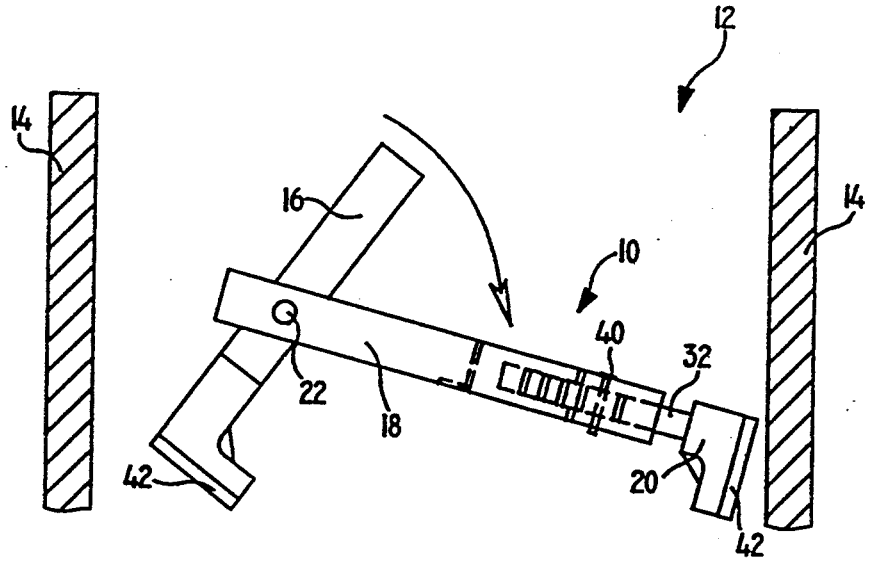
FIG. 2(*a*) is a side elevational view of the shelf of FIG. 1(*a*)
Figure 2B:
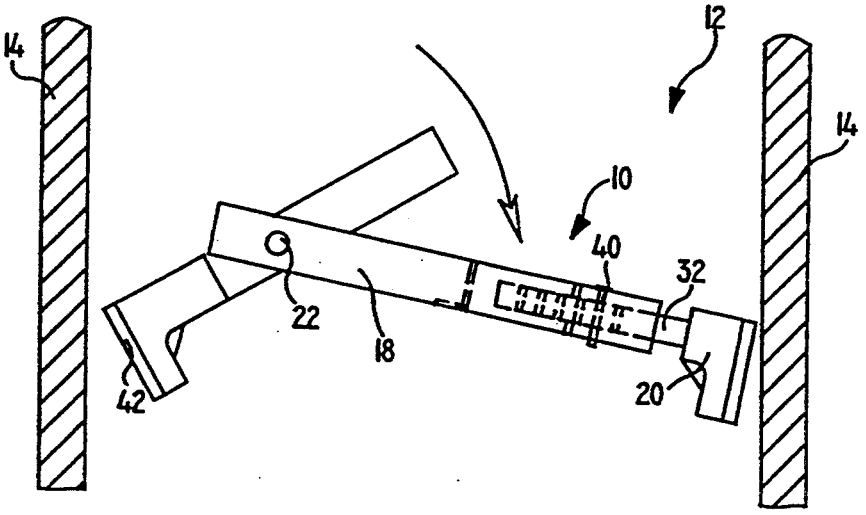
Figure 2C:
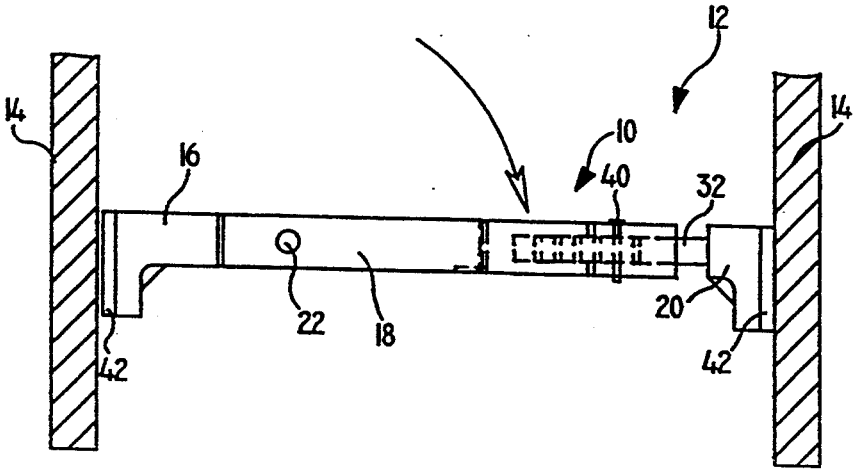

The sequence of installation of shelf 10 is illustrated in FIGS. 1 and 2. With reference to FIGS. 1(*a*) and 2(*a*), shelf 10 is first placed within enclosure 12 in a semi-collapsed position at the desired vertical height. Shelf 10 is then manually depressed as shown in FIGS. 1(*b*) and 2(*b*) until it assumes the fully deployed, horizontal orientation shown in FIGS. 1(*c*) and 2(*c*). In the fully deployed position, the shelf end surfaces frictionally engage adjacent sidewalls 14 of enclosure 12 to securely maintain shelf 10 at the desired height.

Figure 3:
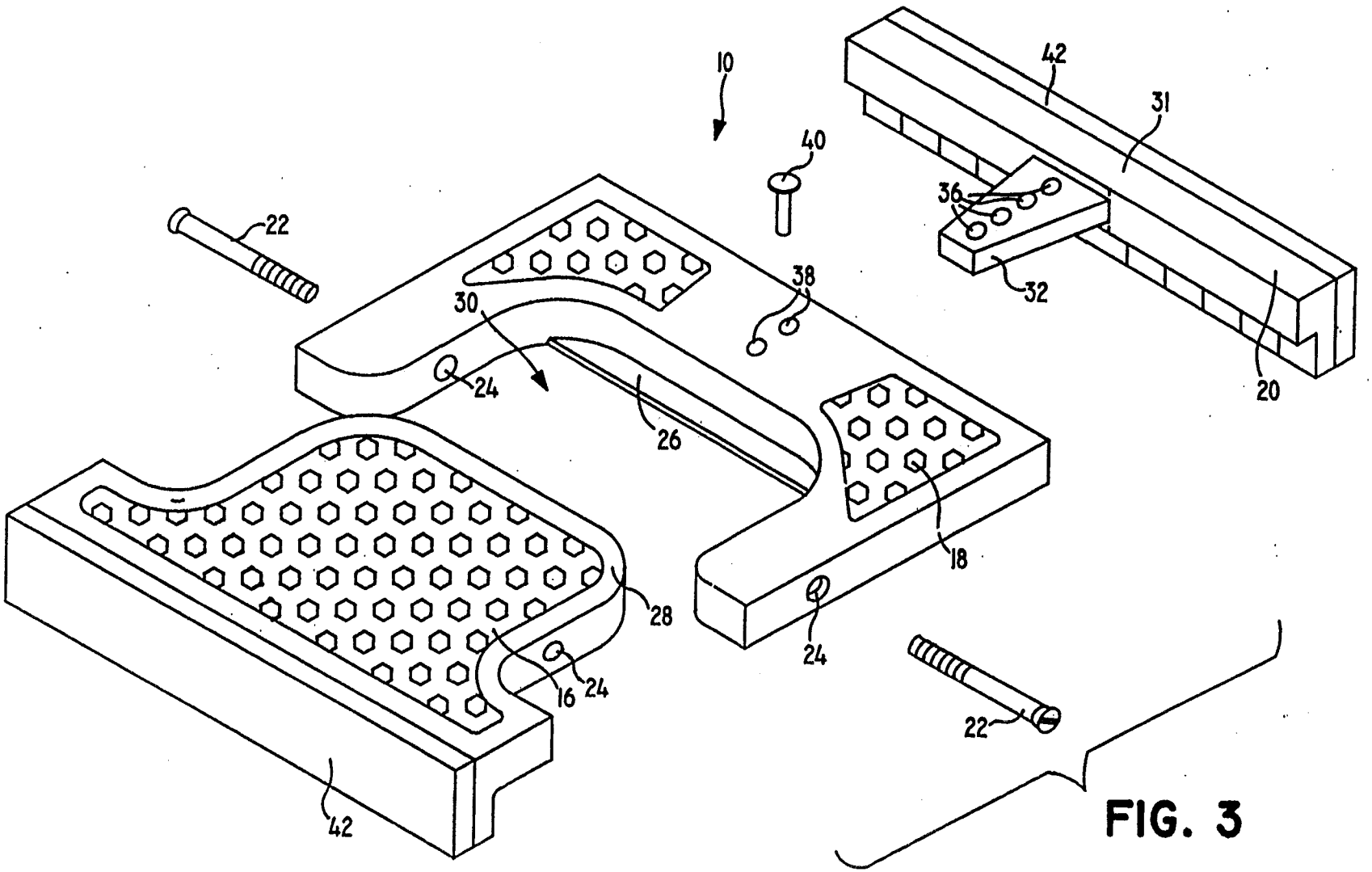
FIG. 3 is an exploded view of the shelf of FIG. 1.

As shown best in FIG. 3, shelf 10 consists of three separate sections 16, 18 and 20 which are assembled together. Shelf sections 16 and 18 are pivotably coupled with a pair of fasteners 22 insertable into apertures 24 formed in shelf sections 16, 18. Shelf section 16 is pivotable relative to shelf section 18 about the axis of fasteners 22 between the semi-collapsed position referred to above (wherein sections 16 and 18 extend in intersecting planes) and the fully deployed position (wherein shelf sections 16 and 18 extend in the same horizontal plane for supporting a load). A stop plate 26 is provided on shelf section 18 to prevent downward pivoting movement of shelf section 16 beyond the horizontal plane of shelf section 18 in the fully deployed position.

Figure 4:
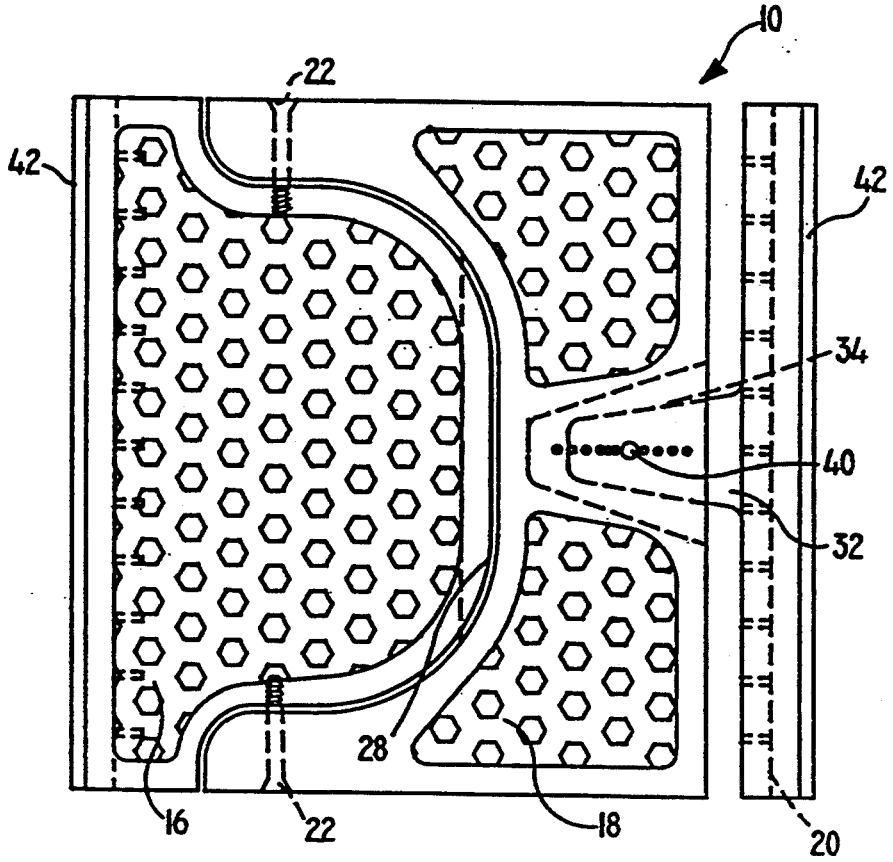
FIG. 4 is a top, plan view of the shelf of FIG. 1 in its fully deployed position.
Figure 5:
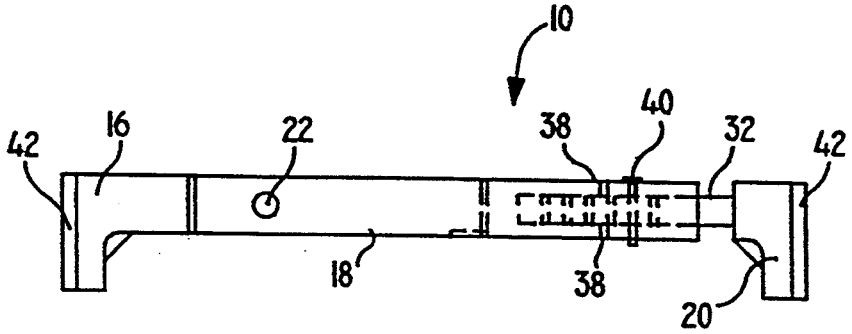
FIG. 5 is a side elevational view of the shelf of FIG. 4.
Figure 6A:
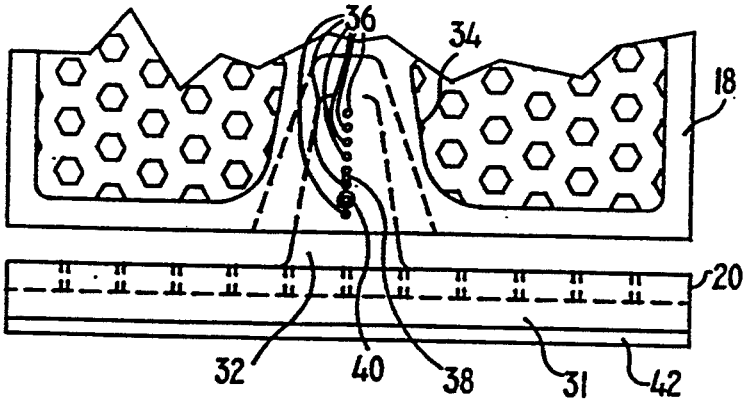
FIG. 6(*a*)–(*d*) are a series of fragmented, plan views illustrating the adjustable end portion of the shelf of FIG. 1.
Figure 6B:
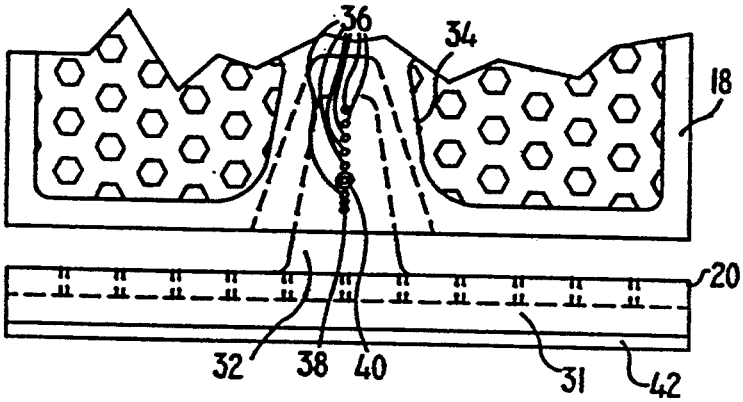
Figure 6C:
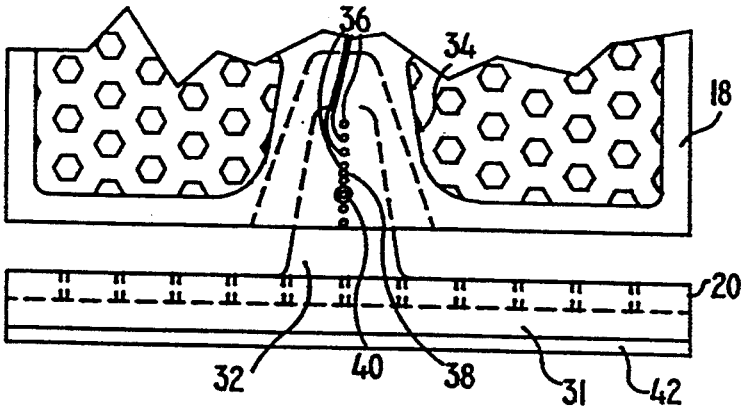
Figure 6D:
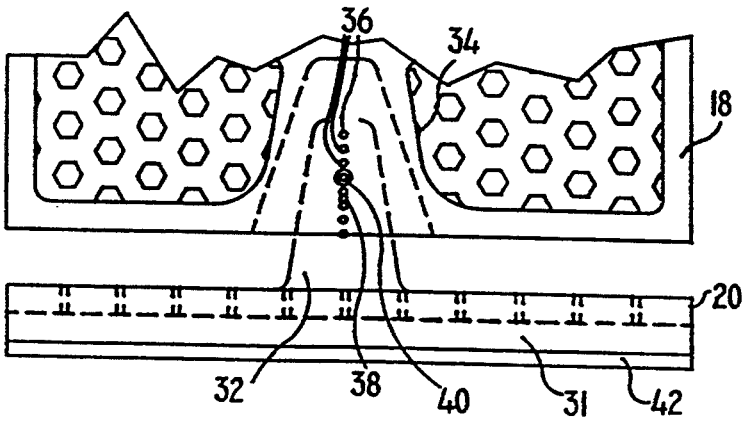
Figure 7A:
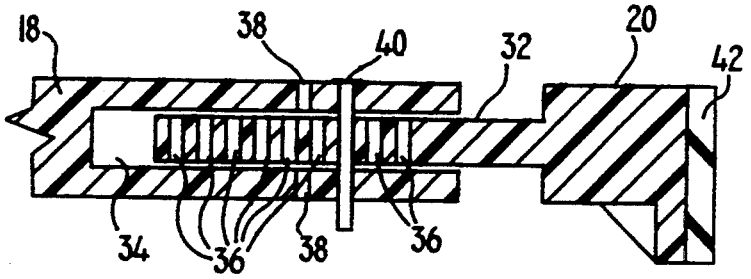
FIG. 7(*a*)–(*e*) are a series of fragmented, longitudinal sectional views of the adjustable end portion of the shelf of FIG. 1.
Figure 7B:
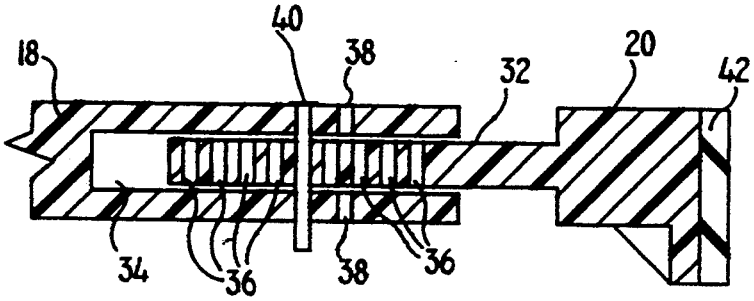
Figure 7C:
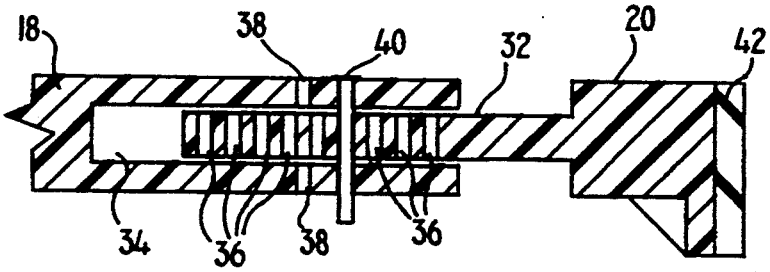
Figure 7D:
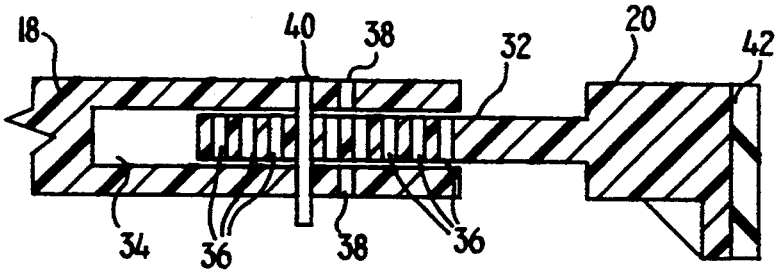
Figure 7E:
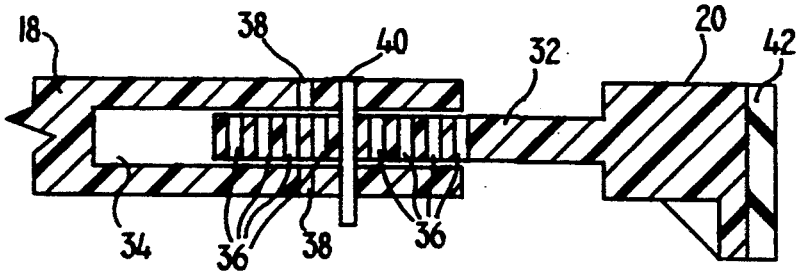

In the preferred embodiment, shelf section 16 is generally D-shaped and includes an arcuate inner end 28 which is received within a corresponding U-shaped cut-out portion 30 formed in shelf section 18. Stop plate 26 is an integral extension of the bottom wall of shelf section 18 which extends within cut-out portion 30 to limit pivotal motion of inner end 28 of section 16 as described above. Shelf sections 16, 18 together define a generally rectangular load-supporting surface in the fully deployed position (FIG. 4). As should be apparent to someone skilled in the art, shelf sections 16 and 18 of other shapes and dimensions would function equally well.

In order to complete assembly of shelf 10, sections 18 and 20 are releasably coupled together. Shelf section 20 consists of an elongated body 31 having a prong 32 projecting laterally from a central portion thereof. As best shown in FIGS. 4–7, shelf section 20 is coupled to shelf section 18 by inserting prong 32 into a mating slot 34 formed in a central portion of shelf section 18. Prong 32 has a plurality of regularly spaced-apart apertures 36 which are alignable with one or more mating apertures 38 extending vertically through shelf section 18. A pin 40 is provided for insertion into the aligned apertures 36, 38 to releasably couple shelf sections 18, 20 together.

As shown best in FIGS. 6 and 7, the distance between shelf sections 18, 20 (and hence the overall length of shelf 10) may be varied depending upon the extent that prong 32 is inserted within slot 34. Accordingly, small incremental adjustments may be readily made to vary the overall length of shelf 10 to ensure that it fits snugly within the enclosure 12 in question.

Figure 8A:
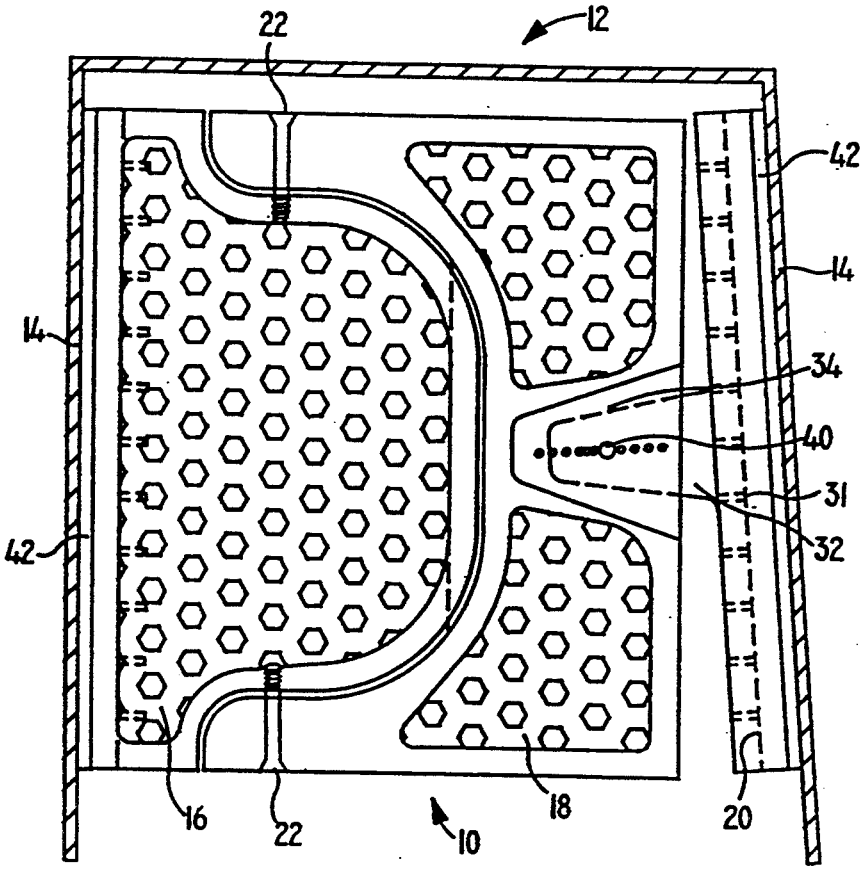
FIG. 8(*a*) is a top, plan view of the shelf of FIG. 1 in its fully deployed position installed within an enclosure having diverging sidewalls.
Figure 8B:
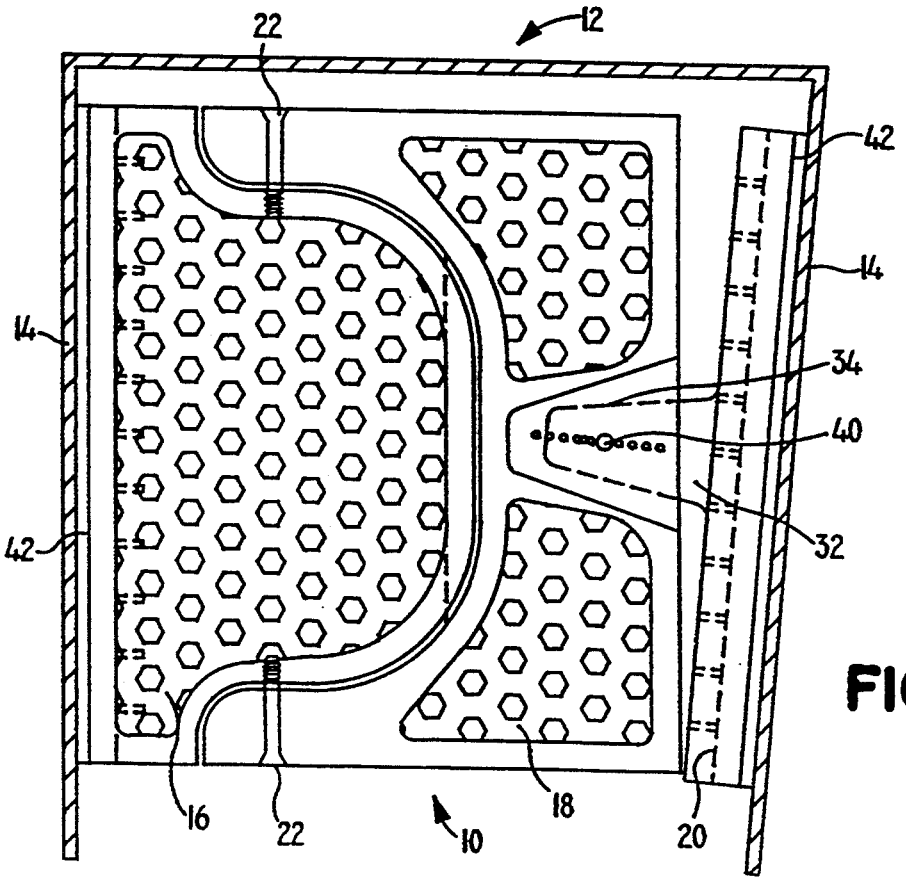

As shown best in FIGS. 8(*a*) and (*b*), shelf section 20 is pivotable from side to side relative to shelf section 18 about the axis of pin 40. This allows shelf 10 to fit snugly within an enclosure 12 having non-parallel sidewalls 14. The maximum extent of pivotable motion depends upon the extent that elongate body portion 31 of shelf section 20 is spaced apart from shelf section 18. As shown in FIGS. 8(*a*) and (*b*), shelf section 18 may be pivoted about prong 32 until the lateral ends of body portion 31 contact the adjacent ends of shelf section 18. This limited degree of pivotable movement enables adjustment of shelf 10 to conform to the shape of enclosures 12 having diverging (FIG. 8(*a*)) or converging (FIG. 8(*b*)) sidewalls 14.

As shown best in FIG. 3, the outer end surfaces of shelf sections 16 and 20 are preferably covered with gripping surfaces 42. Gripping surfaces 42 frictionally engage an adjacent enclosure sidewall 14 when shelf 10 is installed within enclosure 12 as shown in FIGS. 1 and 2. Gripping surfaces 42 are constructed from rubber or any other suitably resilient material which will not deface or mark enclosure sidewalls 14.

The upper, load-supporting surfaces of shelf 10 may also be covered with a non-skid material having an aesthetically pleasing pattern.

In operation, shelf 10 may be readily installed in an enclosure 12, such as a school or gym locker, without defacing or modifying the enclosure's interior sidewalls 14 and without the need for any tools or fasteners. As shown best in FIGS. 1(*a*) and 2(*a*), shelf 10 is first placed within enclosure 12 in a semi-collapsed position with shelf section 16 pivoted about the axis of fasteners 22. In the semi-collapsed position, shelf section 16 extends in a plain intersecting the plane of shelf sections 18 and 20. This reduces the overall length of shelf 10 which facilitates placement of shelf 10 within the interior of enclosure 12.

After shelf 10 is placed at the desired vertical position within enclosure 12, the inner end 28 of shelf section 16 is manually depressed as shown in FIGS. 1(*b*) and 2(*b*) so that it pivots downwardly toward a horizontal orientation co-planer with shelf sections 18, 20. As the inner end 28 of shelf section 16 is pressed downwardly, gripping surfaces 42 covering the outer ends of shelf sections 16 and 20 frictionally engage the enclosure sidewalls 14.

Once the installer is satisfied that gripping surfaces 42 are level, shelf section 16 is firmly pressed downwardly until shelf 10 snaps solidly into the fully deployed position shown in FIGS. 1(*c*) and 2(*c*). As shelf section is pressed downwardly, gripping surfaces 42 contact sidewalls 14 with a sufficient degree of frictional force to securely maintain shelf 10 at the desired height. In the fully deployed position, inner end 28 of shelf section 16 contacts stop plate 26 on shelf section 18, thereby preventing shelf section 16 from pivoting past the horizontal.

Shelf 10 may be easily withdrawn from enclosure 12 in question by reversing the pivoting motion described above (i.e. by pivoting shelf section 16 upwardly relative to shelf section 18).

If, after the initial installation, shelf 10 does not snugly fit within the enclosure 12 in question, its overall length may be incrementally adjusted as described above by varying the extent to which prong 32 is inserted within the corresponding slot 34 formed within the central portion of shelf section 18. The installer need only withdraw pin 40 from shelf section 18 by lifting it upwardly, and then realign prong apertures 36 with the appropriate shelf aperture 38. Pin 40 may then be reinserted through apertures 36,38 to securely couple shelf sections 18 and 20 together.

As shown in FIGS. 8(*a*) and 8(*b*), if the enclosure 12 has non-parallel sidewalls 14, then shelf section 20 may be pivoted from side to side relative to shelf section 18 to ensure that gripping surface 42 securely engages the adjacent sidewall 14 along its entire length. This ensures that shelf 10 exerts even pressure on opposed sidewalls 14 which is critical to maintain shelf 10 securely in place.

When installed as aforesaid, shelf 10 is capable of supporting a substantial load without deflecting from the fully deployed position. The inventor anticipates that shelf 10 would be of use by students wishing to customize the set-up of their school locker to suit their personal needs. For example, shelf 10 could be used to support books, binders or sports equipment. Since shelf 10 is fully portable, it could be removed from the locker in question at the end of the school term or season and used in other lockers in subsequent years. Moreover, since installation of shelf 10 does not permanently modify or deface the interior sidewalls 14 of the locker, school officials would likely not be opposed to its widespread use.

As will be apparent to those skilled in the art in the light of the foregoing disclosure, shelf 10 could be used in a wide variety of other applications. Many alterations and modifications are possible in the practice of this invention without departing from the spirit or scope thereof. Accordingly, the scope of the invention is to be construed in accordance with the substance defined by the following claims.

What is claimed is:

1. A shelf removably mountable within an enclosure having generally opposed interior sidewalls, such as a locker cabinet, said shelf comprising:

(a) a first section having first gripping means for releasably engaging one of said enclosure sidewalls;

(b) a second section pivotably coupled to said first section; and (c) a third section coupled to said second section and having second gripping means for releasably engaging the other of said enclosure sidewalls, wherein said shelf is manually adjustable between a semi-collapsed position wherein said first and second sections extend in intersecting planes to facilitate placement of said shelf within said enclosure and a deployed position wherein said first and second gripping means engage respective enclosure sidewalls and wherein said first, second and third sections extend in a substantially common plane for supporting a load, said third section being pivotable relative to said second section within said common plane to accommodate enclosures having non-parallel sidewalls.

2. The shelf as defined in claim 1, further comprising coupling means for releasably coupling said shelf second and third sections, wherein said coupling means is adapted for adjusting the displacement between said shelf second and third sections to vary the overall length of said shelf.

3. The shelf as defined in claim 2, wherein said coupling means comprises a prong projecting from a central portion of said third section and insertable within a mating slot formed in a central portion of said second section.

4. The shelf as defined in claim 3, wherein said coupling means further comprises a pin insertable through mating apertures formed in said prong and said second section for releasably coupling said second and third shelf sections together, said third section being pivotable about the axis of said pin.

5. The shelf as defined in claim 2, wherein said first and second gripping means each comprise a resilient gripping surface for frictionally engaging said enclosure sidewalls.

6. The shelf as defined in claim 5, wherein said first and second gripping means comprise elongated surfaces for uniformly distributing said load to said enclosure sidewalls.

7. The shelf as defined in claim 6, wherein said first and second gripping means are affixed to opposed end surfaces of said shelf.

8. The shelf of claim 1, wherein said shelf second section further comprises stop means for limiting pivotable movement of said first section relative to said second section when said shelf is in said deployed position.

9. The shelf as defined in claim 1, wherein said first, second and third sections together define a rectangular support surface in said fully deployed position for supporting said load.

10. The shelf as defined in claim 9, wherein said first section has a generally D-shaped portion which is received in a generally U-shaped recessed portion formed in said second section when said shelf is in said fully deployed position.

* * * * *